United States Patent [19]

Maier et al.

[11] Patent Number: 4,555,199

[45] Date of Patent: Nov. 26, 1985

[54] SUPPORT FOR ENDLESS GRINDING SLEEVES

[76] Inventors: Peter Maier, Gerokstrasse 1, 7311 Neidlingen; Roland Schirrmacher, Forellenstrasse 74, D-8084 Bachern am Wörthsee; Rolf Simen, Birnblutenweg 15, D-7000 Stuttgart 80, all of Fed. Rep. of Germany

[21] Appl. No.: 553,058

[22] Filed: Nov. 18, 1983

[30] Foreign Application Priority Data

Nov. 25, 1982 [DE] Fed. Rep. of Germany ..... 3243598

[51] Int. Cl.[4] ..... F16D 1/06

[52] U.S. Cl. ..... 403/370; 51/168

[58] Field of Search ..... 403/370, 371; 51/168, 51/380

[56] References Cited

U.S. PATENT DOCUMENTS

| | | | |
|---|---|---|---|
| 3,171,666 | 3/1965 | Benjamin et al. | 403/371 X |
| 3,182,986 | 5/1965 | Brockman | 403/370 X |
| 3,501,183 | 3/1970 | Stratienko | 403/370 |
| 3,503,638 | 3/1970 | Holzel | 403/370 |
| 3,656,785 | 4/1972 | Lothar | 403/370 |

FOREIGN PATENT DOCUMENTS

| | | | |
|---|---|---|---|
| 158077 | 1/1921 | United Kingdom . | |
| 560083 | 6/1977 | U.S.S.R. | 403/371 |

*Primary Examiner*—Andrew V. Kundrat
*Attorney, Agent, or Firm*—McGlew and Tuttle

[57] ABSTRACT

A support for endless grinding sleeves for grinding workpieces has a casing which axially running slots or grooves and the support has a round outline in cross section. An axial hole through the support becomes narrower along its length and is designed to receive a wedging cone that is to be drivingly joined with a shaft. The outer surface of the support is made somewhat smaller in size than the inner circumference of the endless grinding sleeve that is to be placed on the support and the cone is driven into the support to radially expand it into engagement with the sleeve.

11 Claims, 7 Drawing Figures

SUPPORT FOR ENDLESS GRINDING SLEEVES

FIELD AND BACKGROUND OF THE INVENTION

The present invention relates to supports for endless grinding sleeves.

In the prior art such supports have been designed for example in the form of grinding rolls or grinding porcupines. The casing of known grinding rolls or grinding porcupines is made of rubber-like rods or bristles forming the desired elastic connection between the grinding porcupine and the endless grinding sleeve. The rods extend radially outwardly and form the casing of the support. In this case the rods are all of the same size so that the casing part of the grinding porcupine is cylindrical. A shortcoming experienced with these known systems is that on pressing them against a workpiece the endless grinding sleeve is strongly bent and may be turned in relation to the roll in the circumferential direction. If there is such bending and twisting of the endless grinding sleeve, parts of the same are likely to be overstrained and in many cases this will be the cause of damage to the sleeve. Furthermore the endless grinding sleeve is likely to be damaged at the time it is being fixed in place on the grinding roll, because the outer diameter of the roll is always made a little smaller than the inner diameter of the endless grinding sleeve because of the production tolerances may not in all cases be completely realized. In the case of grinding rolls with a metal outer case the grinding outer face of the grinding sleeve is not elastic and giving enough in its properties.

SUMMARY OF THE PRESENT INVENTION

Taking this prior art as a starting point, one purpose or object of the present invention is that of designing a support or carrier of the sort noted hereinbefore so that there is no longer any trouble in positioning the endless grinding sleeve on the support.

A still further purpose of the invention is to make certain that in such cases there is generally no chance of the sleeve being twisted in relation to the support.

An even further purpose of the invention is to make certain that the sleeve generally speaking keep its form throughout its working life and when being used.

Furthermore the sleeve of the invention is to be such that, as a base for the grinding sleeve, its properties are elastic enough.

These and other purposes are effected in keeping with the present invention in that the support is made up of, an outer sleeve of foamed material or rubber with the endless grinding sleeve thereon, a cylindrical casing within the the outer sleeve, and a wedging cone which extends in the support. The casing of the support has at least one axially running slot or groove and a cross sectional outline of the support is round. A hole extends through the structure axially, and becomes narrower conically to receive the wedge cone, that may be keyed, that is to say torque-transmittingly joined, on a shaft or other support means, and furthermore the outer circumference of the support is a little smaller than an inner hole through the endless grinding sleeve to be fixed on the support.

The useful effects produced by the invention are to be seen more specially in the simple way of placing or fixing the endless grinding sleeve on the support, more specially inasfar as it is possible in the invention for the outer surface of the support to be made with a smooth finish so that the sleeve may be slipped onto the support without any marked friction or resistance. A driving or keyed connection between the sleeve and the support is made possible at any time, even if the grinding sleeves, when mass produced, have some tolerance in size. This is because the outer circumference of the support may more or less always be changed somewhat as desired by the effect of the wedging cone and by the presence of a slot or groove in the casing of the support. In this respect however the outer form (that is round or cylindrical) of the support is not changed. A further useful effect to be experienced with the present invention is that the grinding sleeve as supported on the support is not changed while it is being used so that the work may be very accurately machined. In the case of the prior art it is not possible to be certain of the outer face of the grinding porcupine being completely round as desired because of the bristles being forced inwardly.

Further useful effects of the invention will be seen from the claims.

As part of one useful development of the present invention there are a number of slots or slits in the casing that may be placed parallel to the middle axis of the support, although it is furthermore possible for them to be helical. This design measure is a simple way of making certain that the outer surface of the support is in fact round, that is to say circular, and cylindrical even in those cases in which the radius of the support is increased by the effect of the wedging cone. A further useful effect produced by the slots is that the diameter of the support is increased in a simple way, more particularly inasfar as such increase is produced without any great force being needed.

In keeping with a measure of the invention, which is of great value, the one end of the slots is freely open to the outside in the axial direction and the other end of the slots comes to an end within the casing, the open ends of each slot and the one next to it being at opposite ends of the casing. This part of the design makes possible not only an even radial distribution of the forces of the support acting on the sleeve, but furthermore there is the especially useful effect of an even axial distribution of these forces.

As a further part of the invention the hole within the support is frusto-conical, the part of the wedging cone that is to be placed in the hole in the support having a form matching at least part of the hole into which it is to be fitted. The axial length of the wedging cone may be smaller than the axial length of the support. It is in this way that the invention makes use of the known effect of a frusto-conical wedge.

There is a further useful development of the general idea of the invention wherein the casing part of the support is in the form of a prestressed sleeve made of rubber-like material, onto which the endless grinding sleeve may be fixed in place by friction. This part of the design makes certain that there is always the desired elastic joint between the grinding sleeve and the support, there being however a limited deformation of the grinding sleeve on machining the work, because the elasticity of a sleeve made of rubber-like material is made possible even if it is not very thick. In this respect it is best if the sleeve made of rubber-like material is somewhat chamfered at its top end so that it is then simpler for the grinding sleeve to be put in place.

The support, in keeping with the present invention, will as a rule be joined up with a turning shaft. In this connection it is possible, as a useful part of the invention, for the wedging cone to have an axial hole therein into which the shaft may then be placed and joined up with the wedging cone. A connection between the wedging cone and the shaft may furthermore however be so produced by making the wedging cone with a stem running out axially from its thinner end and that may be with or without a screw thread. In the case of this design of the wedging cone the same may be directly screwed to the shaft. Lastly it is possible for the wedging cone to have a blind note at its thinner end so that the shaft may then be screwed into this hole.

A detailed account will now be given of the invention using the working examples thereof to be seen in diagrammatic figures herein.

DESCRIPTION OF THE PREFERRED EMBODIMENTS

Figure 7:
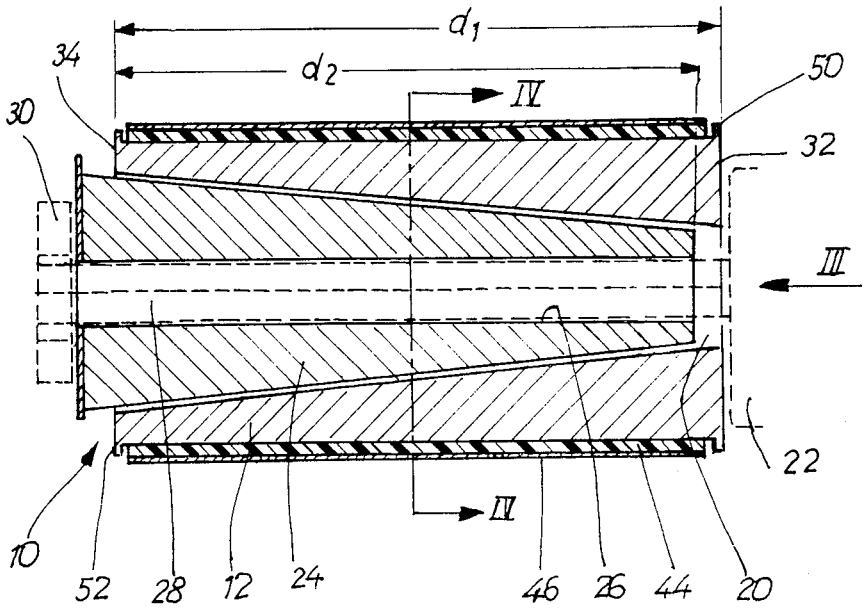
FIG. 7 is an axial sectional view taken through a further working example of the invention.

Referring to the drawings in particular, the invention embodied in FIG. 7 comprises a support 10 for an endless grinding sleeve 46. The support 10 includes, as a major part thereof, a casing 12 which, in cross section, has a circular outer outline. The outer surface of casing 12 is cylindrical. Casing 12 includes a hole 20 therethrough which is frusto-conical. Hole 20 becomes narrower in the direction toward a shaft 22 on which the support 10 also includes a wedging cone 24 which has a central hole 26 therethrough. Wedging cone 24 is received in hole 20 of casing 12 and is mounted on a journal 28 extending axially from shaft 22. Journal 28 extends through hole 26 of wedging cone 24. Wedging cone 24 is held on shaft 22, and urged into the frusto-conical hole 20 of support 12, by a screw 30 which is threaded into the journal 28. Screw 30, shaft 22 and its journal 28 are shown in broken line in FIG. 7.

Figure 3:
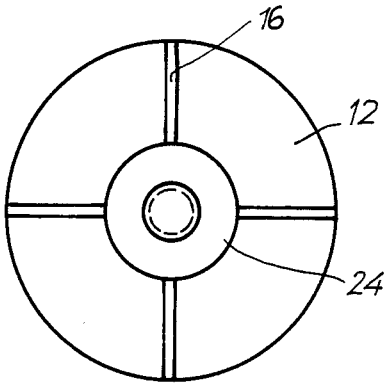
FIG. 3 is an elevational view of the structure shown in FIG. 7, in the direction of the arrow III.
Figure 4:
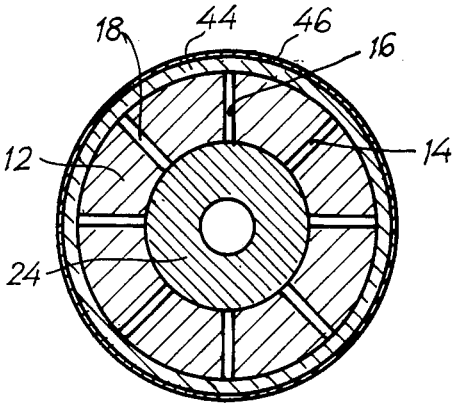
FIG. 4 is a cross sectional view taken along the line IV—IV of FIG. 7.
Figure 5:
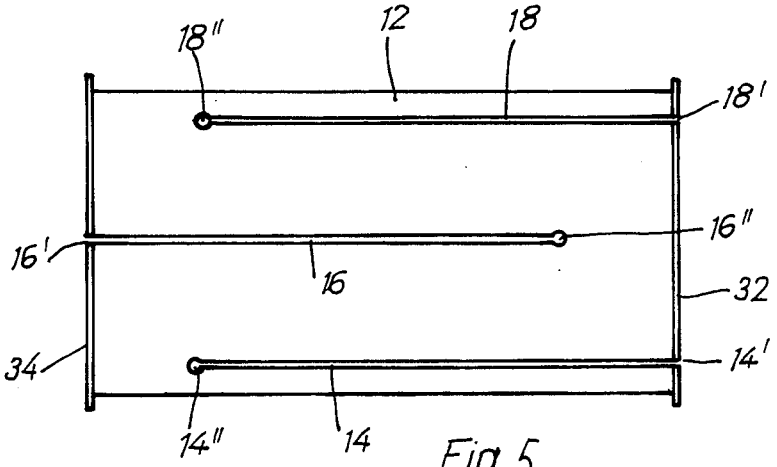
FIG. 5 is a side elevational view of the support whose casing may be seen to have a number of axial blind slots therein.

As may be seen from FIGS. 3 to 5 the casing 12 has a number of slots 14, 16 and 18 therein which extend parallel to the middle or central axis of the support 10. The one end 14', 16' and 18' of the slots 14, 16 and 18 in each case is axially open to the outside. The other ends 14'', 16'' and 18'' come to an end blindly within the casing 12. The slots 14, 16 and 18 are so formed that the open ends 14', 16' and 18' of one slot and the slot next to it come to an end at opposite axial ends 32 and 34 of the casing 12.

Figure 6:
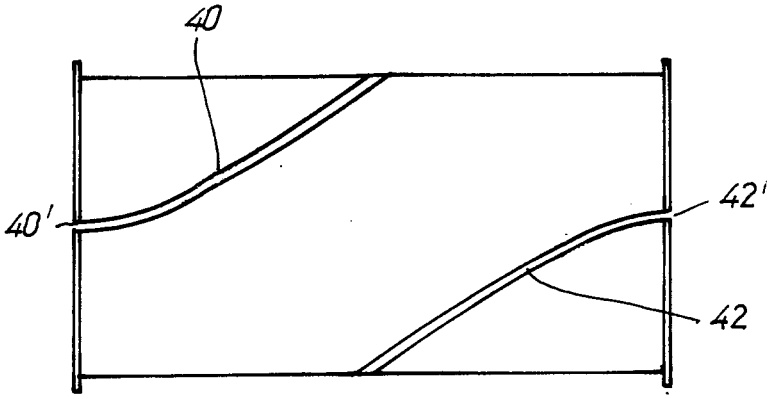
FIG. 6 is a view similar to FIG. 5 showing a support with helical slots.

In an alternate form shown in FIG. 6, the casing may include helical slots 40 and 42.

It is furthermore to be seen from FIG. 7 that the wedging cone 24, placed within the hole 20 of casing 12, has a form matching that of hole 20 in which it is fitted.

In this respect the axial length $d_2$ of part of wedging cone 24 which extends in hole 20, is smaller than the axial length $d_1$ of the support 12. The support 12 has a prestressed sleeve 44 thereon made of rubber-like material, on which the endless grinding sleeve 46 is placed. The support 10 at its two axial ends 32 and 34, has larger diameter portions which form flanges or steps at 50 and 52 so that the elastic sleeve 44 may be permanently fixed to the support 10.

The inside diameter of the grinding sleeve 46 is slightly larger than the outside diameter of the elastic sleeve 44 when the cone 24 is not fully seated, although this is shown in the figures. It is for this reason, that the grinding sleeve 45 is simpler to put on the support 10 or on the rubber sleeve 44. However, another way of making it simpler to put the grinding sleeve in place is for the top end of the sleeve 44 to be somewhat chamfered.

Figure 2:
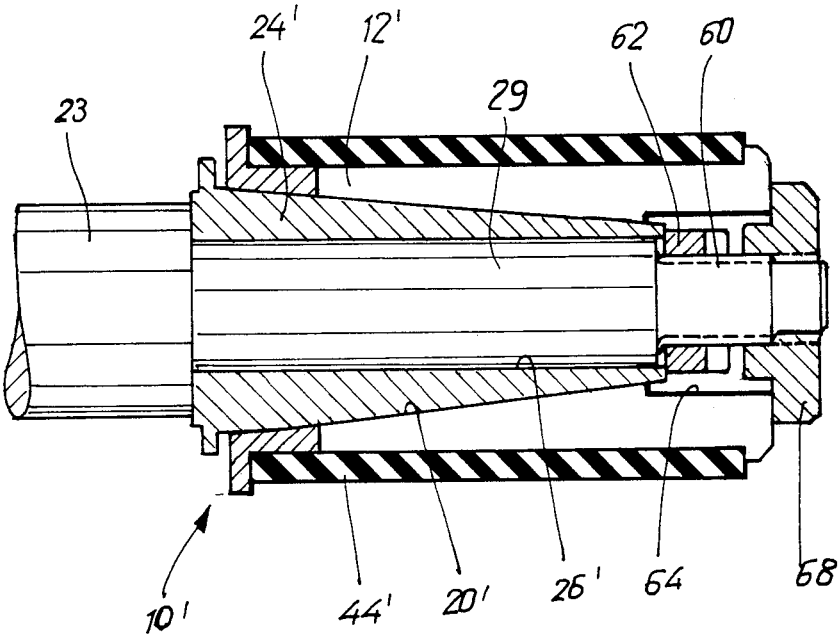
FIG. 2 is a side view partly in section of a further working example of the support of the invention.

In FIG. 2, another way will be seen of joining a wedging cone 24' to a driving shaft 23, and in this case, the thinner end of the wedging cone 24' is pointing towards the end of a journal 29 of the driving shaft 23. The end of the journal 29 of the driving shaft 23 has a thread at 60. The wedging cone 24' is joined by way of a nut 62 with the driving shaft journal 29, such nut being placed in a hole 64 in the casing 12'. An axial wedging effect between the wedging cone 24' and the casing 12' is produced using a nut 68 so that the connection between the support 10 and the driving shaft 23 is not dependent on the axial wedging effect acting on the casing 12'. In FIG. 2, elements similar to those in FIG. 7 bear the same reference numerals but with primes.

A further possible way of producing a connection between the wedging cone and the shft 23 is one in which the wedging cone has an axial stem or shank with a screw thread at its thinner end. By using this thread it is then possible for wedging cone to be done up using an axial hole in the driving shaft. Another possible form of connection between the wedging cone and the shaft is one in which the wedging cone has an axial blind hole with a female thread to take up a male-threaded driving shaft.

A point always to be taken into account in connection with the design of the wedging cone is that its degree of taper is to be kept within a certain range. If the degree of taper is overly great, the wedging effect will not be great enough. In the opposite case, in which its degree of taper is not great enough the casing of the support and the wedging cone may become so strongly fixed together that there is a self-locking effect. It has been seen from experience that it is best if the point at which the base of the wedging cone is cut by the generatrix of the outer face of the wedging cone is such that the angle between the generatrix and the base is 10° to 30°. A preferred angle is 20°.

Figure 1:
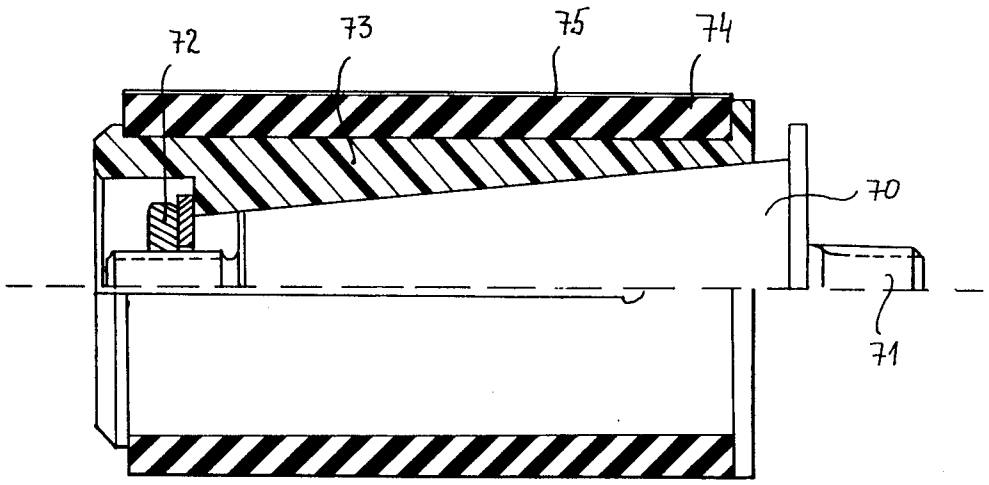
FIG. 1 is an axial sectional view through a support in keeping with the present invention with an endless grinding sleeve.

In the design of FIG. 1 a wedging cone 70 is made of aluminum or synthetic resin with strips of cloth let into it and is made in one piece with a shaft 71. There is a nut 72 for connecting the grinding sleeve tightly to the support. The support has a casing 73 is in the form of a synthetic resin sleeve (or wedging sleeve) with slots running in from its two ends. There is furthermore a cylindrical outer sleeve 74 of foam material or of rubber-like material giving the desired elastic grinding effect. The endless grinding sleeve is marked 75.

We claim:

1. A support for an endless grinding sleeve, comprising:

a casing having a cylindrical outer surface and an axially extending conical inner hole therethrough, said casing having a pair of spaced apart flanges protruding outwardly of said cylindrical surface, said casing having a plurality of blind slots extending therein, each slot having a first end opening at one axial end of said casing and a second end terminating within said casing, a first end of one slot being adjacent a second end of a next slot around said casing;

an elastic lining of rubber-like material engaged on said cylindrical surface of said casing between said flanges and adapted to support an endless grinding sleeve thereon;

a wedging cone having an outer conical surface substantially mating with said conical inner hole of said casing;

a shaft connected to said wedging cone for carrying said casing and elastic lining; and screw thread means engaged with said wedging cone and said casing for urging said wedging cone into said conical inner hole of said casing for radially expanding said casing.

2. The support as claimed in claim 1 wherein said slots are parallel to a middle axis of said support.

3. The support as claimed in claim 1 wherein said slots are helical.

4. The support as claimed in claim 1, wherein said wedging cone has an axial length extending in said conical inner hole which is smaller than an axial length of said casing.

5. The support as claimed in claim 4, wherein said casing includes a recess communicating with a narrow end of said conical inner hole and having a diameter greater than a narrow end of said conical inner hole, said screw thread means including a nut threadably engaged with one of said shaft and said wedging cone and disposed in said recess.

6. The support as claimed in claim 5, wherein said shaft includes a journal, said wedging cone including a hole therethrough for receiving said journal, said journal including a threaded end extending axially into said recess, said nut threaded on said threaded end of said journal and engaging against said wedging cone, said screw thread means including a second nut threaded to said threaded end of said journal and engaging against said casing.

7. The support as claimed in claim 5, wherein said wedging cone is fixed to said shaft, said wedging cone including a threaded end extending into said recess, said nut threaded onto said threaded end of said wedging cone and engaging against said casing for urging said wedging cone into said conical inner hole of said casing.

8. The support as claimed in claim 1, wherein said wedging cone has a further hole therethrough, said shaft including a large diameter portion engaged against said casing and a small diameter portion extending through said further hole of said wedging cone, said journal having a threaded end extending axially out of said wedging cone, said screw thread means including a nut threaded to said end of said journal and engaged against said wedging cone for urging said wedging cone into said conical inner hole of said casing, said wedging cone tapering inwardly away from said nut and having a length extending in said casing which is less than a length of said casing in the axial direction.

9. The support as claimed in claim 1, wherein said wedging cone tapers at an angle which is selected so that no self-locking effect occurs between said wedging cone and said conical inner hole of said casing so that said wedging cone can be removed from said casing with loosening of said screw thread means.

10. The support as claimed in claim 9, wherein a generatrix of said wedging cone and an axis of said support form an angle of from 10° to 30°.

11. The support as claimed in claim 10, wherein said angle is 20°.

* * * * *